United States Patent [19]

Kuhlmann

[11] 4,206,312

[45] Jun. 3, 1980

[54] COOLED JACKET FOR ELECTRIC ARC FURNACES

[75] Inventor: Herbert Kuhlmann, Bochum, Fed. Rep. of Germany

[73] Assignee: Sidepal S.A. Societe Industrielle de Participations Luxembourgeoise, Luxembourg

[21] Appl. No.: 969,453

[22] Filed: Dec. 14, 1978

[30] Foreign Application Priority Data

Dec. 19, 1977 [LU] Luxembourg ..... 78707

[51] Int. Cl.[2] ..... F27B 3/24; F27D 1/12

[52] U.S. Cl. ..... 13/32; 165/169; 432/238

[58] Field of Search ..... 13/32, 35; 98/31; 432/238; 122/6 A, 6 B; 110/336; 165/169, 177, DIG. 13

[56] References Cited

U.S. PATENT DOCUMENTS

| | | | |
|---|---|---|---|
| 1,929,444 | 10/1933 | Murray et al. | 122/6 A X |
| 1,970,585 | 8/1934 | Toomey | 122/6 A |
| 3,652,070 | 3/1972 | Sagara | 432/238 X |
| 3,829,595 | 8/1974 | Nanjyo et al. | 13/32 |
| 3,843,106 | 10/1974 | Nanjyo et al. | 13/32 X |
| 4,097,679 | 6/1978 | Fukumoto et al. | 13/32 |
| 4,119,792 | 10/1978 | Elsner | 13/32 |

*Primary Examiner*—Roy N. Envall, Jr.
*Attorney, Agent, or Firm*—McGlew and Tuttle

[57] ABSTRACT

A cooled jacket construction for an electric arc furnace is provided, the jacket consisting of a cooling system embedded in a refractory lining and mounted on a metallic outer shell. The cooling system comprises a plurality of plate-shaped pipe segments arranged side-by-side over the periphery of the furnace and consisting of a pipe-to-pipe construction of substantially cylindrical individual pipes, welded together for guiding a coolant over a serpentine path through the cooling system.

22 Claims, 11 Drawing Figures

COOLED JACKET FOR ELECTRIC ARC FURNACES

BACKGROUND OF THE INVENTION

1. Field of the Invention

The invention relates to industrial furnaces, particularly a cooled jacket for electric arc furnaces.

2. Description of the Prior Art

Electric arc furnaces are in general use for the production of special steels. The body of the furnace mainly consists of a cylindrical casing, a convex base forming a furnace shell and a convex cover. The casing includes a feed aperture and a pouring aperture fitted with a spout and usually provided on the opposite side to the aperture, while the cover includes the apertures required for the electrodes. The body of the furnace is mounted on rollers and can be emptied by tilting it. The internal walls of the furnace have a more or less thick refractory lining serving to absorb the considerable heat to which they are exposed.

It has been found that with the very high temperatures which naturally occur in these arc furnaces the side casing, which consists of a metal armoring with a refractory lining, is only just capable of standing up to the high thermal stresses to which it is subjected. The metal armoring is liable to bulge outwards and the lining only has a life of 80–100 charges, i.e. operating cycles, and therefore the armoring has to be renewed frequently. This renewal of the lining involves considerable expense, as well as a reduction in output, as a result of the temporary stoppage thereby caused.

The policy has therefore been adopted of equipping the side of the furnace with a cooling system by integrating cooling boxes into this wall on similar lines to those already known in connection with the operation of blast furnaces. These cooling boxes or cooling elements for arc furnaces can be designed as integral supporting parts of the side of the furnace and arranged in such a manner that a plurality of mutually adjacent cooling elements, preferably curved in the form of a circle, form a belt which in this zone constitutes the side of the furnace. This belt-shaped configuration of cooling elements may be provided on the inside and if necessary on the outside likewise with a refractory coating.

The cooling elements themselves consist of flat curved hollow boxes of about 200–250 mm in thickness, with a water inlet usually provided at the top and a water outlet situated at the bottom. The cooling water passing through the system is caused to flow along a serpentine path by means of horizontal crosspieces provided in mutually offset positions inside the cooling boxes to form baffle-shaped flow channels. It is true that the use of these cooling boxes has enabled the life of the furnace jacket to be considerably increased, but the constructional principle of this cooling system suffers from a number of serious drawbacks.

For technological reasons it is only at certain isolated points on their narrow sides that the aforementioned crosspieces are welded to the housing of the cooling elements. More or less wide gaps are thus left between the narrow sides of the crosspieces and the outer walls of the housing, giving rise to considerable vagabond currents of water and thus detracting from the cooling effect and increasing the water consumption.

Furthermore, the material, particularly the welds of the elements, are subjected by the considerable heat gradient between their sides nearest to the furnace and their outer sides to heavy stresses and to the corresponding latent risk of faults. In addition, these cooling elements, owing to their geometric construction, involving flat boundary walls of large area, with the attendant risk of deformation, are unsuitable for operation where comparatively high water pressures occur, so that their cooling efficiency remains relatively limited. The interior of these cooling boxes also includes numerous blind angles, particularly in the zone where the water is guided around the free ends of the crosspieces, increasing the risk of eddies and steam bubbles and the resulting local heat accumulation and greater resistance to flow. The higher manufacturing costs are a further disadvantage of these known cooling boxes.

SUMMARY OF THE INVENTION

The purpose of the invention is to avoid these drawbacks of the prior art by providing a cooled jacket for industrial furnaces which involves only moderate production costs and ensures efficient cooling by providing the most favourable flow conditions for the cooling medium, the geometrical construction selected for the cooling system being that required for maximum mechanical strength.

In accordance with the present invention there is provided a cooled jacket for electric arc furnaces comprising a plurality of plate-shaped pipe segments, distributed over the periphery of the furnace and consisting of a pipe-to-pipe construction of substantially cylindrical individual pipes, welded together and serving to guide a coolant over a serpentine path, these pipes being embedded in a refractory lining.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

The present invention may be better understood and its objects and advantages will become apparent to those skilled in the art by reference to the accompanying drawings in which.

DESCRIPTION OF THE PREFERRED EMBODIMENT

Figure 1:
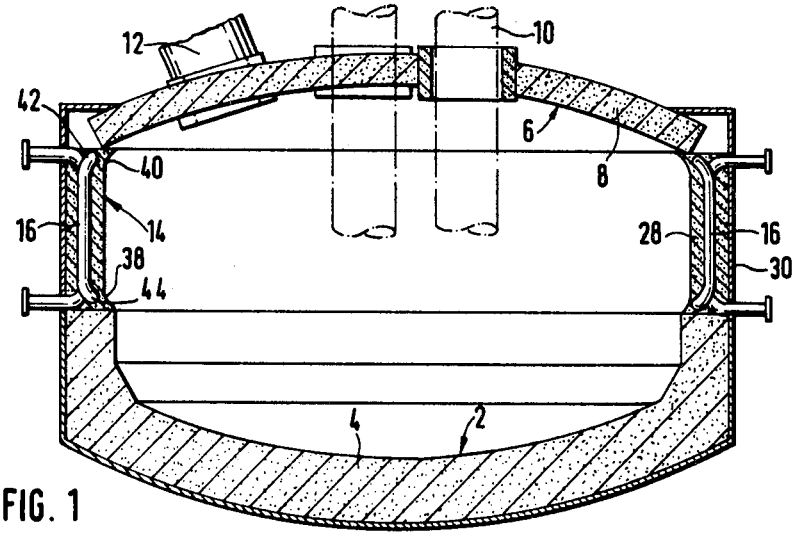
FIG. 1 is a section through a schematic structure of an arc furnace with a cooled jacket.

FIG. 1 shows a section through the general structure of an electric arc furnace having a convex base 2 forming a furnace shell and provided with a refractory lining 4 and also having a convex cover 6, likewise provided with a refractory lining 8, electrodes 10 and a gas discharge pipe 12.

The feed aperture and also the pouring aperture with spout are omitted from the diagram for the sake of simplicity. The cylindrical casing or wall 14 of the furnace is fitted with cooling elements 16 in the form of pipe segments in accordance with the invention.

Figure 2:
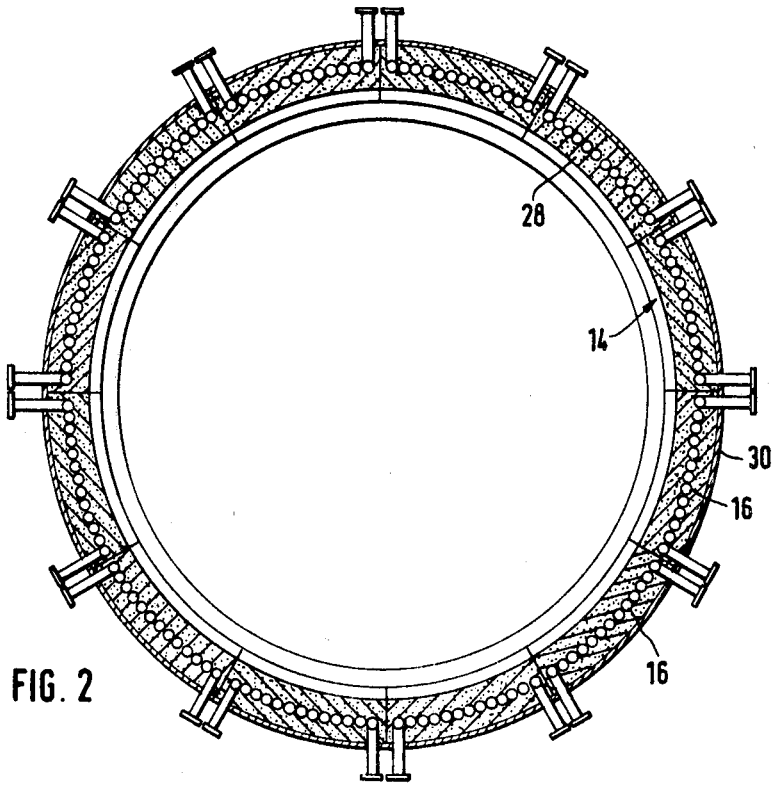
FIG. 2 is a plan view of a cross-section through the furnace shown in FIG. 1.

FIG. 2 is a cross-sectional plan view of the cross-section furnace shown in FIG. 1. FIG. 2 shows the even distribution of a suitable number of pipe segments or assemblies 16 over the entire periphery of the furnace. As may be seen from FIG. 2, these pipe segments may be arranged on a cylindrically curved surface, thus fitting the curvature of the casing of the furnace.

Figure 3:
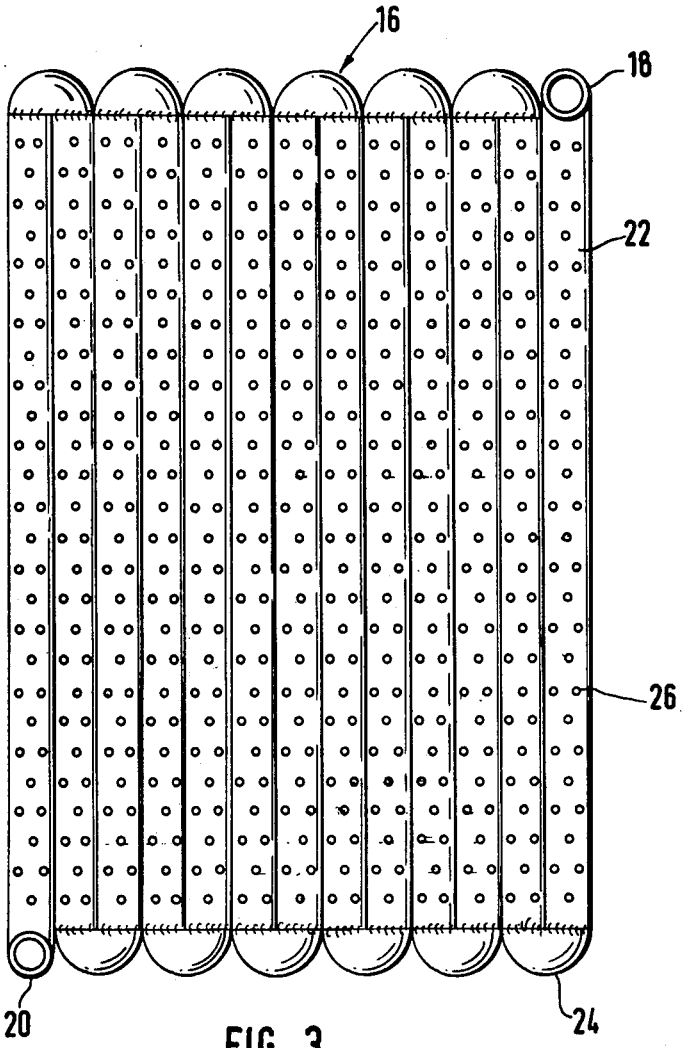
FIG. 3 is an elevational view of a pipe segment for the cooling apparatus shown in FIGS. 1 and 2.

FIG. 3 provides, on a larger scale, an elevation of a pipe segment 16 with an inlet 18, for the cooling medium, provided at the top, and an outlet 20, for the cooling medium, provided at the bottom. Needless to say, the converse positions may be adopted for the inlet and outlet if regarded as advantageous.

It may be seen from FIG. 3 that the cooling elements or pipe assemblies 16 suggested consist of pipes or pipe lengths 22 arranged side by side in a plane configuration or on a surface in the wall and welded together, each adjacent pair being provided with a cap 24, welded onto them and serving as a deflecting device for the coolant. It follows from the way in which the pipes 22 are aligned in the preferred embodiment shown in FIG. 3 that the serpentine path adopted for the coolant takes a vertical direction the pipe lengths being disposed substantially radially of the cylindrical wall.

Figure 4:
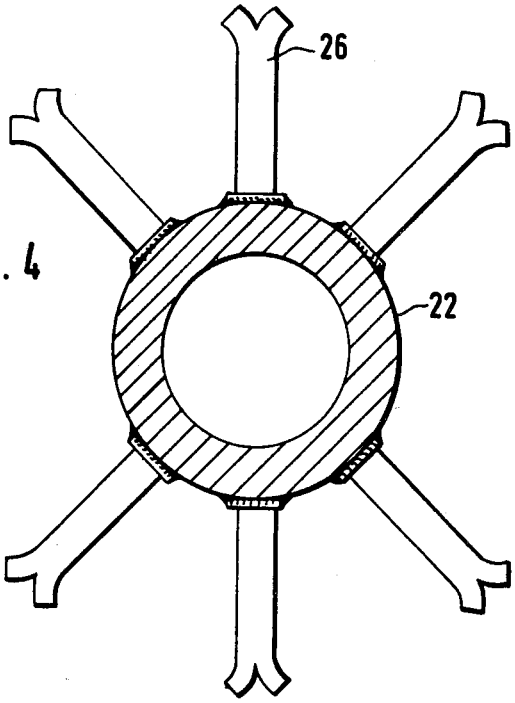
FIG. 4 is a cross-section through a pipe of the pipe segment shown in FIG. 3, with a system of studding.

FIG. 3, like FIG. 4 (cross-section through a cooling pipe 22), shows a system of studding 26, of sufficient heat-resisting material, serving to secure the pipe segments in a refractory lining 28 (FIG. 1 and FIG. 2) of the casing 14 of the furnace.

Figure 5:
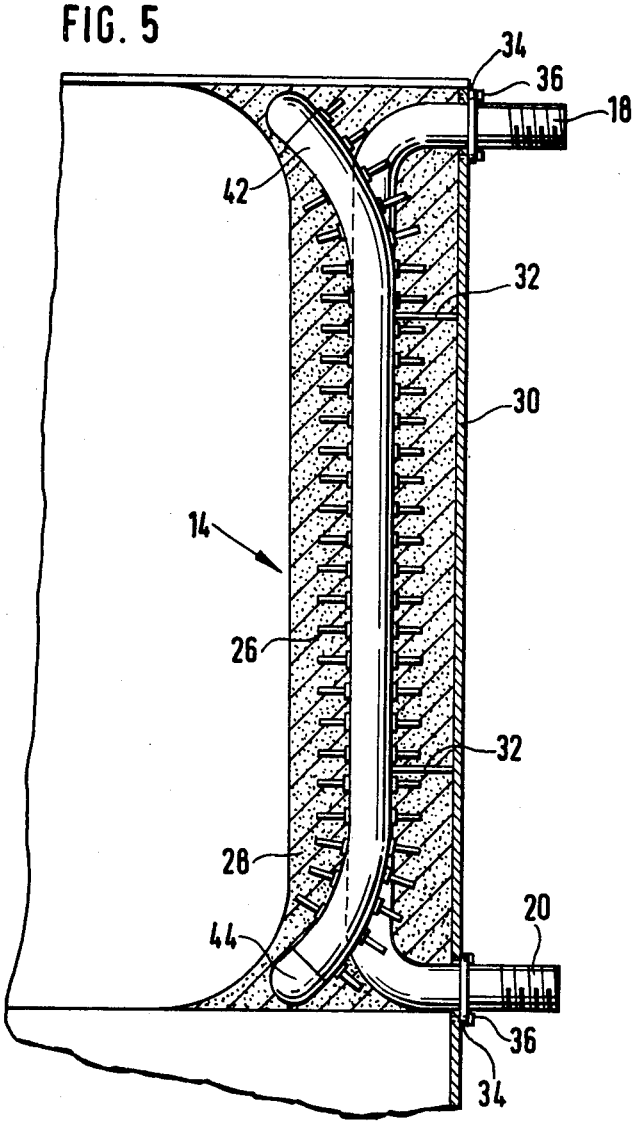
FIG. 5 is a section, on a larger scale, through the jacket cooling system shown in FIG. 1, with a refractory lining for the cooling elements and with details of the assembly system.

FIG. 5 shows further details of the way in which the pipe segments 16 are mounted in the casing 14 of the furnace. This latter, in the version shown, mainly consists of a steel-plate supporting armoring 30 of the shape of a reversed "L", to which the pipe segments 16 are affixed by means of iron spacers 32 and flanges 34 around the coolant inlets and outlets 18 and 20 and also by the aid, for example, of a screw connection 36. The armoring 30 of the casing likewise preferably consists of cylindrically curved segments (not shown) in such a way that each armouring segment forms one complete constructional unit in conjunction with one of the pipe segments. The resulting unit consisting of a casing segment in conjunction with a pipe segment is filled in with refracting material 28, this refractory armoring 28 being made thicker, starting from the pipe segments 16 and preferably towards the interior of the furnace rather than towards the furnace armouring 30, in order to ensure that the temperature gradient will take a more favourable course.

It is also of advantage for the refractory lining 28 to comprise portions 38 and 40 of increased cross-section and the bottom and top for forming the transition to the furnace shell 2 and to the furnace cover 6 respectively. As it has been found by experience that these transitional portions 38 and 40, particularly the transition 38 to the furnace shell 2 are exposed to considerable heat and erosion, individual ends of pairs of pipes, interconnected by a deflecting cap 24, can be bent over towards the interior of the furnace, as indicated at 42 and 44 (FIGS. 1 and 5). This measure provides more intensive cooling for the endangered zones 38 and 40.

Figure 6:
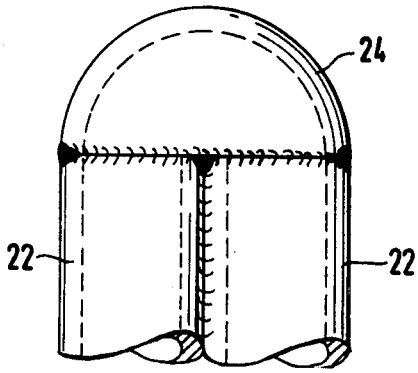
FIG. 6 is an elevation of a deflecting cap for two adjacent cooling pipes.

FIG. 6 shows on a larger scale the deflecting caps 24 which are known per se and each of which are tightly welded and interconnect two adjacent pipe ends, in order to effect a 180°—deflection of the coolant, e.g. water or steam.

Figure 7:
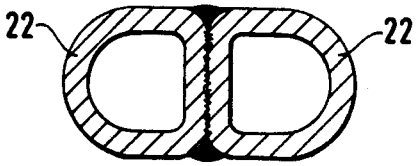
FIG. 7 is a plan view of two adjacent pipe ends prior to the attachment of the deflecting cap shown in FIG. 6.

FIG. 7 shows the cross sectional shape for the pipe ends which is known per se and which the otherwise round pipes 22 acquire as a result of being expanded before the deflecting caps 24 are mounted and welded onto them.

Figure 8:
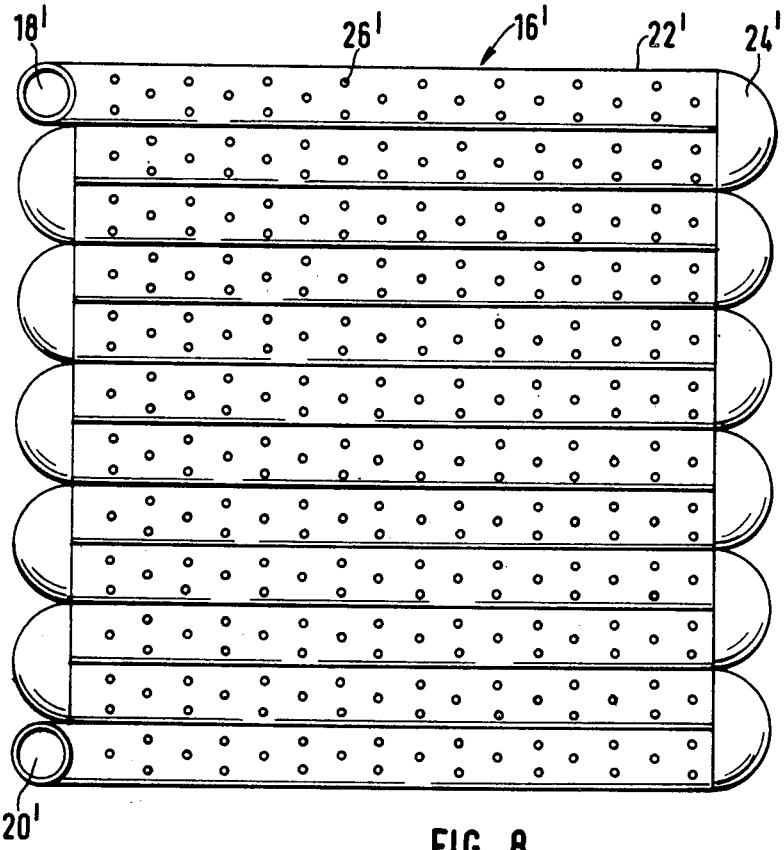
FIG. 8 is an elevation of a pipe segment, the cooling pipes being aligned horizontally.
Figure 8A:
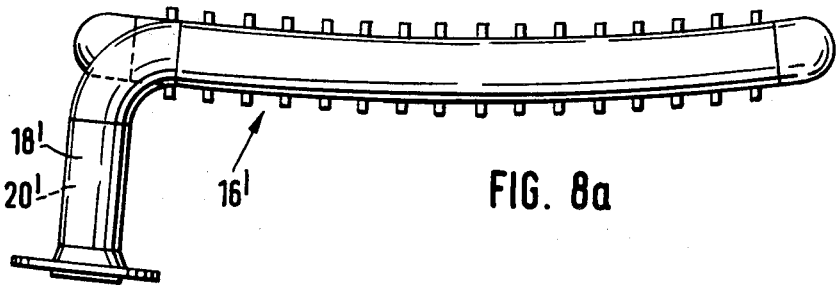
FIG. 8*a* is a plan view of the pipe segment shown in FIG. 8.

FIG. 8 shows a pipe segment 16′ in which the cooling pipes 22′ are aligned horizontally, i.e. in which the coolant is guided over a horizontal path, while FIG. 8*a* is a plan view of a pipe segment 16′ of this kind, curved cylindrically in accordance with the curvature of the furnace casing. Pipe lengths of FIG. 8 are thus disposed circumferentially of the cylindrical wall.

It should be noted in addition that the coolant used may naturally consist not only of water or steam (saturated steam, hot steam) but also of other media, such as inert gases, e.g. helium or nitrogen.

It should be noted in particular that the cooling of the side of the furnace offers the advantage, of particular importance during periods of power shortage, that the heat eliminated is partly recoverable by means of heat exchangers or similar means, so that from this point of view likewise the cooling of the sides of the electric furnaces is an important factor, all the more so if it proves feasible in the advantageous version described.

Figure 9:
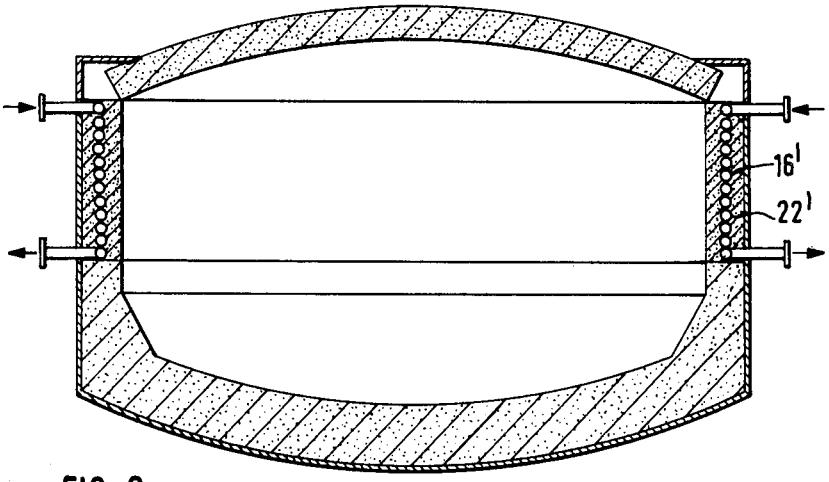
FIG. 9 is a section through the schematic diagram of an arc furnace with cooling segments arranged as in FIG. 8, the cooling pipes being aligned horizontally.
Figure 9A:
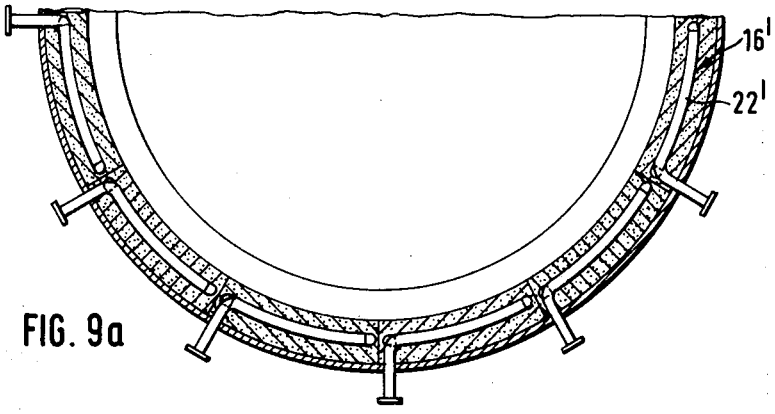
FIG. 9*a* is a plan view of one half of the cross section provided through the furnace of FIG. 9.

FIGS. 9 and 9*a* show how pipe segments 16′ in which the cooling pipes 22′ are aligned horizontally are built into a furnace casting. The horizontal path imparted to the coolant in this version of the pipe segment system largely corresponds to that prevailing in the cooling boxes already known and mentioned farther back, but the design now suggested obviates the drawbacks inherent in these cooling boxes as already described.

The advantages which the cooled jacket proposed for industrial furnaces provides, from the point of view of the operator in this branch of industry, can be summarized by stating that the use of expensive cooling boxes with inadequate cooling efficiency is replaced by an economical pipe system providing favourable flow conditions for the coolant. Due to the shape selected for the piping, extreme stability of shape and resistance to stresses is also achieved. The system thus ensures high flow speeds for the coolant, without any appreciable formation of eddies, and also enables high pressures to be obtained. The new cooling apparatus thus provides the maximum cooling effect at the minimum cost. The aforementioned subdivision of the casing of the furnace into segments, consisting of a combination of furnace armoring segment and cooling pipe segment, with a refractory filling, provides a simple means of removing and replacing any individual elements which require overhaul or have developed faults.

While specific embodiments of the invention have been shown and described in detail to illustrate the application of the principles of the invention, it will be understood that the invention may be embodied otherwise without departing from such principles.

What we claim is:

1. Cooled jacket for electric arc furnaces comprising a plurality of plate-shaped pipe segments distributed over the periphery of the furnace and consisting of a pipe-to-pipe construction of substantially cylindrical individual pipes, welded together and serving to guide a coolant over a serpentine path, said pipes being embedded in a refractory lining.

2. Cooled jacket in accordance with claim 1, wherein each individual pipe segment has an inlet for the coolant and an outlet for the coolant.

3. Cooled jacket in accordance with claim 1, wherein the pipe segments are curved cylindrically.

4. Cooled jacket in accordance with claim 1, wherein the pipes carrying the coolant are positioned vertically.

5. Cooled jacket in accordance with claim 1, wherein the pipes carrying the coolant are positioned horizontally.

6. Cooled jacket in accordance with claim 1, wherein the pipe segments are provided with a system of studding, as a means of affixing them to the lining.

7. Cooled jacket in accordance with claim 1, wherein the pipe segments are mounted in furnace armour segments with which they form a constructional unit.

8. Cooled jacket in accordance with claim 1, wherein the refractory lining is thicker from the pipe segments to the interior of the furnace than between the pipe segments and a furnace armor.

9. Cooled jacket in accordance with claim 8, wherein the refractory lining comprises portions of increased cross-section forming a transition to the shell of a furnace and to a cover of the furnace respectively.

10. Cooled jacket in accordance with claim 9, wherein cooling pipes bent aside extend into the transitional portions of larger cross section.

11. Cooled jacket in accordance with claim 7, wherein the pipe segments and furnace armour segments, forming a constructional unit, can be individually mounted in the side of the furnace and dismantled therefrom.

12. Cooled jacket in accordance with claims 1 to 11, wherein the thermal energy eliminated from the coolant is partly recoverable in heat exchangers.

13. A cooled jacket for cooling an electric arc furnace with a cooling medium comprising an armor layer forming a wall of the electric arc furnace, a refractory lining on said armor layer facing an interior of the electric arc furnace, a plurality of pipe lengths extending substantially parallel to each other in side-by-side orientation within a surface in said refractory lining with respective ends thereof adjacent to each other, a deflecting cap connected between open ends of each pair of adjacent pipe lengths in said surface with said deflecting cap of one end of said pipe lengths being offset from said deflecting cap at an opposite end of said pipe lengths to form a serpentine path through said plurality of pipe lengths for the cooling medium.

14. A cooled jacket according to claim 13 wherein said wall of the electric arc furnace is a cylinder, said plurality of pipe lengths comprising a pipe assembly, a plurality of said pipe assemblies disposed in said cylindrical wall, said surface being a segment of a cylinder.

15. A cooled jacket according to claim 14 wherein said plurality of pipe lengths are disposed circumferentially to said cylindrical wall.

16. A cooled jacket according to claim 14 wherein said pipe lengths are disposed substantially radially of said cylindrical wall.

17. A cooled jacket according to claim 16 wherein the electric arc furnace has a cover member disposed over one end of said cylindrical wall and a base member disposed under an opposite end of said cylindrical wall, said refractory lining having portions of increased thickness adjacent said cover and base members.

18. A cooled jacket according to claim 17 wherein said pipe lengths are curved inwardly toward the interior of the electric arc furnace adjacent both ends of said cylindrical wall.

19. A cooled jacket according to claim 14 wherein each of said pipe assemblies includes an inlet connected to one end of one of said pipe lengths at one side of said assembly, and an outlet connected to an opposite end of another of said pipe lengths at an opposite side of said segment.

20. A cooled jacket according to claim 13 further including a plurality of studs extending outwardy from each of said pipe lengths and into said refractory lining.

21. A cooled jacket according to claim 13 wherein said refractory lining is thicker on the side of said plurality of pipe lengths facing the interior of the electric arc furnace than the thickness of said refractory lining between said plurality of pipe lengths and said armor layer.

22. An electric arc furnace with a cooled jacket comprising a cylindrical wall having an outer armor layer and an inner lining of refractory material, a convex cover member over one end of said cylindrical wall, a convex base member over an opposite end of said cylindrical wall, and a plurality of pipe assemblies circumferentially disposed about said cylindrical wall and within said refractory lining, each of said pipe assemblies comprising a plurality of substantially parallel pipe lengths with respective ends adjacent each other, and in side by side orientation within a cylindrical surface in said cylindrical wall, a deflecting cap connecting adjacent ends of adjacent pipe lengths in each of said assemblies for defining a serpentine path, an inlet connected to one end of one pipe length adjacent one side of each of said pipe assemblies and an outlet connected to an opposite end of another pipe length at an opposite side of each of said segments, each of said plurality of pipe lengths with connected deflecting caps being welded to each other in each of said pipe assemblies, and a plurality of studs extending from each of said pipe lengths and each of said pipe assemblies into said refractory lining.

* * * * *